US010502226B2

(12) United States Patent
Lu et al.

(10) Patent No.: US 10,502,226 B2
(45) Date of Patent: Dec. 10, 2019

(54) CENTRIFUGAL BLOWER

(71) Applicant: Delta Electronics, Inc., Taoyuan (TW)

(72) Inventors: Chao-Wen Lu, Taoyuan (TW); Chun-Chih Wang, Taoyuan (TW); Ding-Wei Chiu, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 565 days.

(21) Appl. No.: 15/218,325

(22) Filed: Jul. 25, 2016

(65) Prior Publication Data

US 2017/0184117 A1 Jun. 29, 2017

(30) Foreign Application Priority Data

Dec. 29, 2015 (CN) ..... 2015 1 1015512

(51) Int. Cl.
*F04D 29/30* (2006.01)
*F04D 29/28* (2006.01)
*F04D 25/06* (2006.01)

(52) U.S. Cl.
CPC ..... *F04D 29/282* (2013.01); *F04D 25/0613* (2013.01); *F04D 29/30* (2013.01)

(58) Field of Classification Search
CPC ..... F04D 29/26; F04D 29/28; F04D 29/281; F04D 29/282; F04D 29/38; F04D 29/384; F04D 29/388; F04D 25/0613; F04D 25/064; F04D 29/30; F04D 29/324
USPC ..... 416/223 B
See application file for complete search history.

(56) References Cited

U.S. PATENT DOCUMENTS 6,481,963 B1 * 11/2002 Lin ..... F04D 29/326 415/220
2003/0190234 A1 * 10/2003 Huang ..... F04D 25/088 416/228
2005/0249604 A1 * 11/2005 Wu ..... F04D 29/30 416/244 R
2007/0020085 A1 * 1/2007 Takemoto ..... F04D 17/162 415/93

* cited by examiner

*Primary Examiner* — Justin D Seabe
*Assistant Examiner* — Justin A Pruitt
(74) *Attorney, Agent, or Firm* — Muncy, Geissler, Olds & Lowe, P.C.

(57) ABSTRACT

A centrifugal blower is provided. The centrifugal blower includes a hub, a shaft, a motor, a plurality of blades, a rib, and a first fin. The shaft is connected to the hub. The motor rotates the shaft. Each blade includes a rib and a first fin. The rib is connected to the hub, wherein the rib extends from the hub to an end of the blade. The first fin is disposed on a first side of the rib and connected to the hub, wherein the first fin includes a first surface, the rib protrudes from the first surface, and the thickness of the first fin is less than the thickness of the rib.

10 Claims, 5 Drawing Sheets

CENTRIFUGAL BLOWER

CROSS REFERENCE TO RELATED APPLICATIONS

This Application claims priority of China Patent Application No. 201511015512.6, filed on Des. 29, 2015, the entirety of which is incorporated by reference herein.

BACKGROUND OF THE INVENTION

Field of the Invention

The present invention relates to a centrifugal blower, and in particular to a centrifugal blower with improved efficiency.

Description of the Related Art

Electronic devices tend to be thin and lightweight, and the thickness of a blower in an electronic device must be decreased. However, when the thickness of the blower is reduced, the height of the blades thereof is decreased, and the impelling power of the blower suffers. Given this situation, if the number of blades is increased to improve the impelling power, the wind resistance of the blades is increased. If the thickness of the blades is reduced, the structural strength of the blades is decreased, and the blades become difficult to manufacture by injection molding.

BRIEF SUMMARY OF THE INVENTION

In one embodiment, a centrifugal blower is provided. The centrifugal blower includes a hub, a shaft, a motor, a plurality of blades, a rib, and a first fin. The shaft is connected to the hub. The motor rotates the shaft. Each blade includes a rib and a first fin. The rib is connected to the hub, wherein the rib extends from the hub to an end of the blade. The first fin is disposed on a first side of the rib and connected to the hub, wherein the first fin comprises a first surface, the rib protrudes from the first surface, and the thickness of the first fin is less than the thickness of the rib.

In one embodiment, the rib comprises a top surface and a first lateral surface, the first lateral surface is an inclined surface, and the first lateral surface is connected to the first surface of the first fin.

In one embodiment, the thickness of the rib is 0.3~0.6 mm, the thickness of the first fin is 0.15~0.35 mm, the width of the rib is 30~50% of the total width of the blade, and the width of the first fin is 50~70% of the total width of the blade.

In one embodiment, each blade comprises a second fin, the second fin is disposed on a second side of the rib, the second fin comprises a second surface, the rib protrudes from the second surface, and the thickness of the second fin is less than the thickness of the rib.

In one embodiment, the rib comprises a top surface, a first lateral surface and a second lateral surface, the first lateral surface and the second lateral surface are inclined surfaces, the first lateral surface is connected to the first surface of the first fin, the second lateral surface is connected to the second surface of the second fin.

In one embodiment, the centrifugal blower further includes a housing. A first inlet is formed between the housing and the hub, a second inlet is formed between the housing and the motor, the first fin extends toward the first inlet, and the second fin extends toward the second inlet.

In one embodiment, the thickness of the second fin is greater than the thickness of the first fin.

In one embodiment, the environmental wind resistance of the first inlet is lower than the environmental wind resistance of the second inlet.

In one embodiment, the thickness of the rib is 0.3~0.6 mm, the thickness of the first fin is 0.15~0.35 mm, the thickness of the second fin is 0.15~0.35 mm, the width of the rib is 30~50% of the total width of the blade, the width of the first fin is 20~60% of the total width of the blade, and the width of the second fin is 20~60% of the total width of the blade.

In one embodiment, each blade comprises a notch, and the notch is formed between the second fin and the motor.

In one embodiment, the centrifugal blower further includes a supporting ring, wherein the supporting ring is connected to the ends of the blades.

In one embodiment, the rib comprises a main section and an end section, the thickness of the main section is greater than the thickness of the end section, and the main section is located between the end section and the hub.

In one embodiment, the centrifugal blower further includes a supporting ring, wherein the supporting ring is connected to the ends of the blades, each end section is connected to the supporting ring, the end section is substantially trapezoid-shaped, and a side of the trapezoid-shaped end section is connected to the supporting ring.

In one embodiment, the thickness of the main section is 0.3~0.6 mm, and the thickness of the end section is 0.3~0.6 mm.

In another embodiment, a centrifugal blower is provided. The centrifugal blower includes a hub, a shaft, a motor, a plurality of blades, a rib, and a first fin. The shaft is connected to the hub. The motor rotates the shaft. Each blade includes a rib and a first fin. The rib is connected to the hub, wherein the rib extends from the hub to an end of the blade. The first fin is disposed on a first side of the rib and connected to the hub, wherein the first fin comprises a first curved surface, the rib comprises a top curved surface, the thickness of the first fin is less than the thickness of the rib, and the first curved surface is separated from the top curved surface.

In the embodiment of the invention, the thickness of the first fin is less than the thickness of the rib. The rib (thicker structure) provides sufficient structural strength to the blade. The first fin (thinner structure) impels air flow. Because the thickness of the first fins is decreased, the gaps between the neighboring first fins are increased. The wind resistance and noise of the centrifugal blower are decreased, and the air flow of the centrifugal blower is increased.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
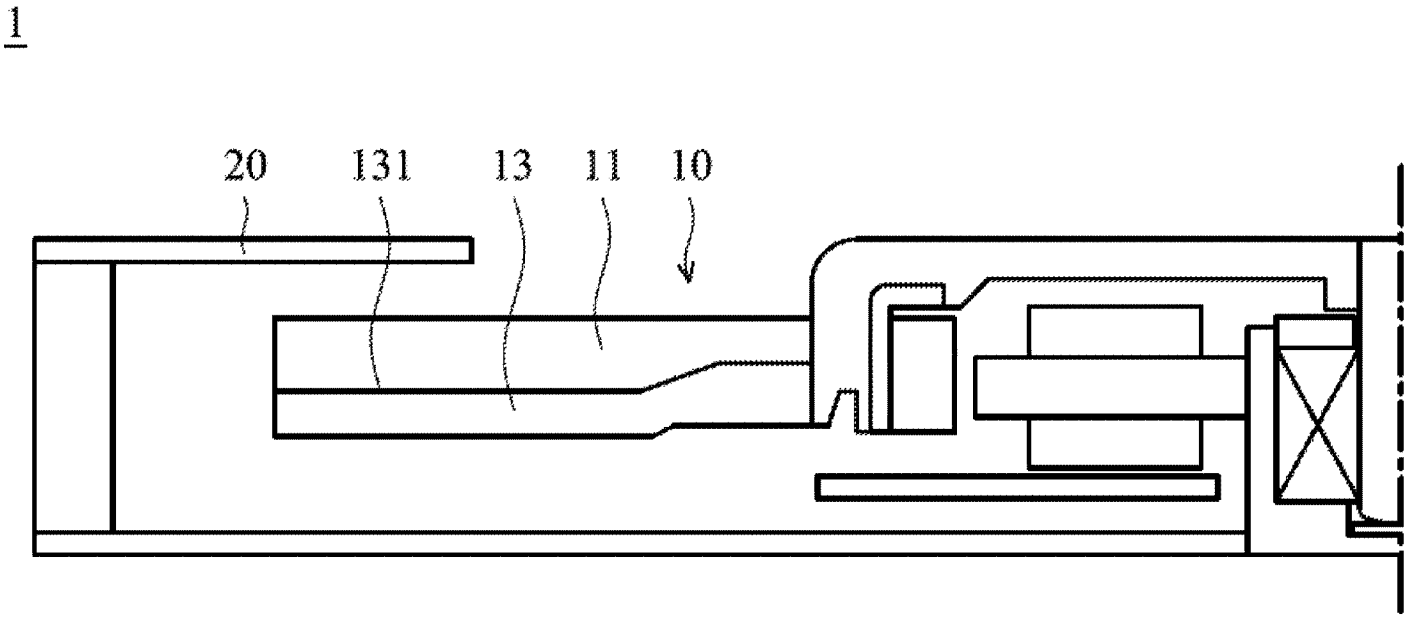
FIG. 1A shows a centrifugal blower of a first embodiment of the invention.
Figure 1B:
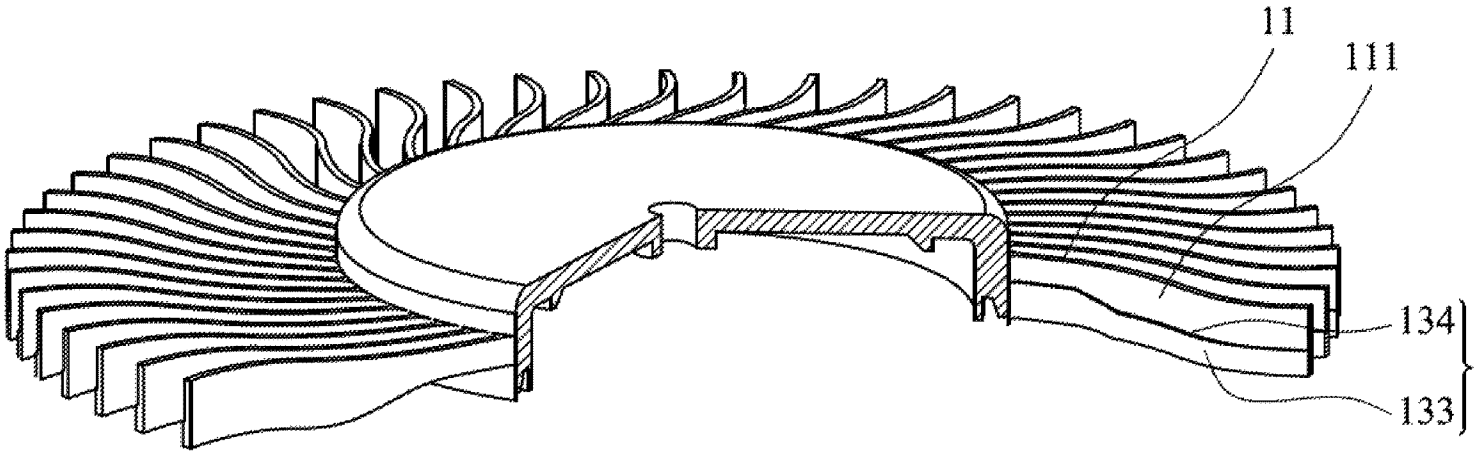
FIG. 1B is a perspective view of a portion of the centrifugal blower of the first embodiment of the invention.

FIG. 1A shows a centrifugal blower 1 of a first embodiment of the invention, which includes a plurality of blades 10. Each blade 10 includes a rib 13, and a first fin 11. The first fin 11 is disposed on a first side 131 of the rib 13. FIG. 1B is a perspective view of the centrifugal blower 1 of the first embodiment of the invention. With reference to FIG. 1B, the first fin 11 comprises a first surface 111, the rib 13 protrudes from the first surface 111, and the thickness of the first fin 11 is less than the thickness of the rib 13.

As to detailed structures: the rib 13 comprises a top surface 133 and a first lateral surface 134. In one embodiment, the first lateral surface 134 is substantially perpendicular to the top surface 133. The first lateral surface 134 is connected to the first surface 111 of the first fin 11. In another embodiment, the first lateral surface 134 is an inclined surface.

In the embodiment of the invention, the thickness of the first fin 11 is less than the thickness of the rib 13. The rib 13 (thicker structure) provides sufficient structural strength to the blade 10. The first fin (thinner structure) 11 impels air flow. Because the thickness of the first fins 11 is decreased, the gaps between the neighboring first fins 11 are increased. The wind resistance and noise of the centrifugal blower are decreased, and the air flow of the centrifugal blower is increased. In one embodiment, the thickness of the rib is 0.3~0.6 mm, the thickness of the first fin is 0.15~0.35 mm, the width of the rib is 30~50% of the total width of the blade, and the width of the first fin is 50~70% of the total width of the blade. In one embodiment, the total width of the blade is 1.2~5 mm. According to the ratio above, the wind resistance of the centrifugal blower is decreased, and the air flow of the centrifugal blower is increased. Additionally, the structural strength and reliability of the centrifugal blower is improved.

Figure 2A:
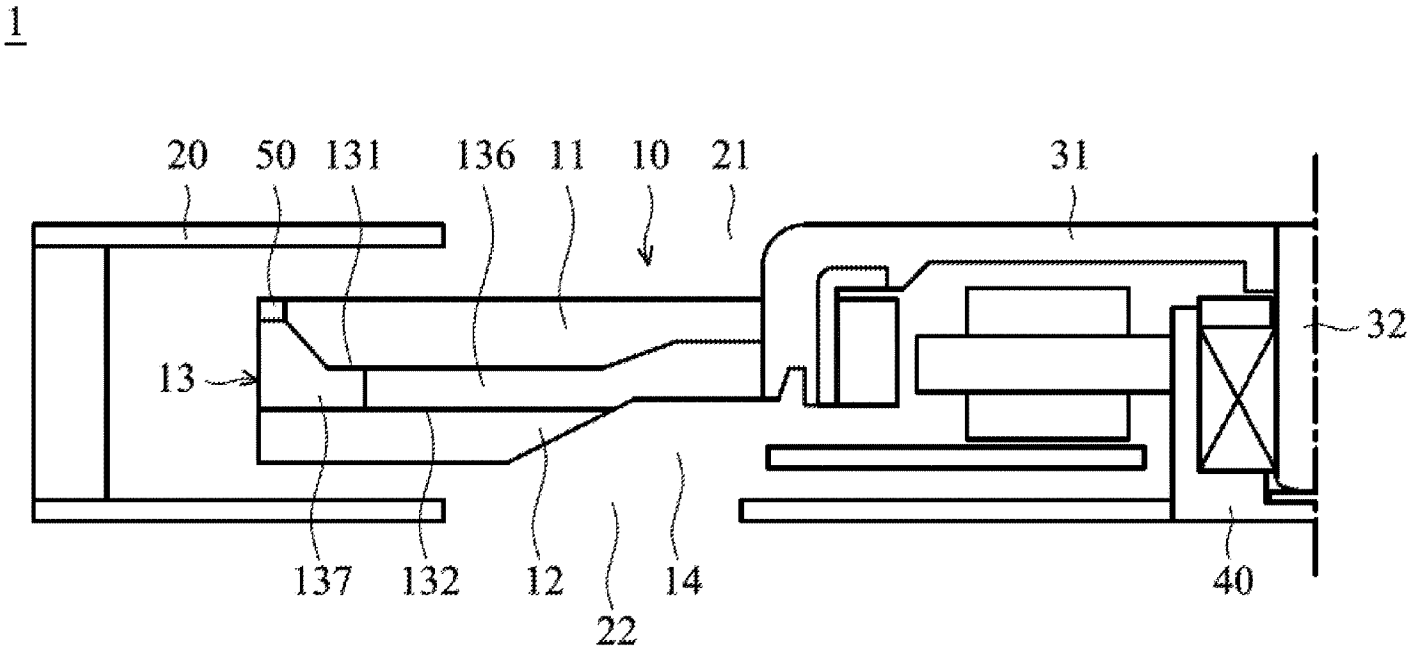
FIG. 2A shows a centrifugal blower of a second embodiment of the invention.
Figure 2B:
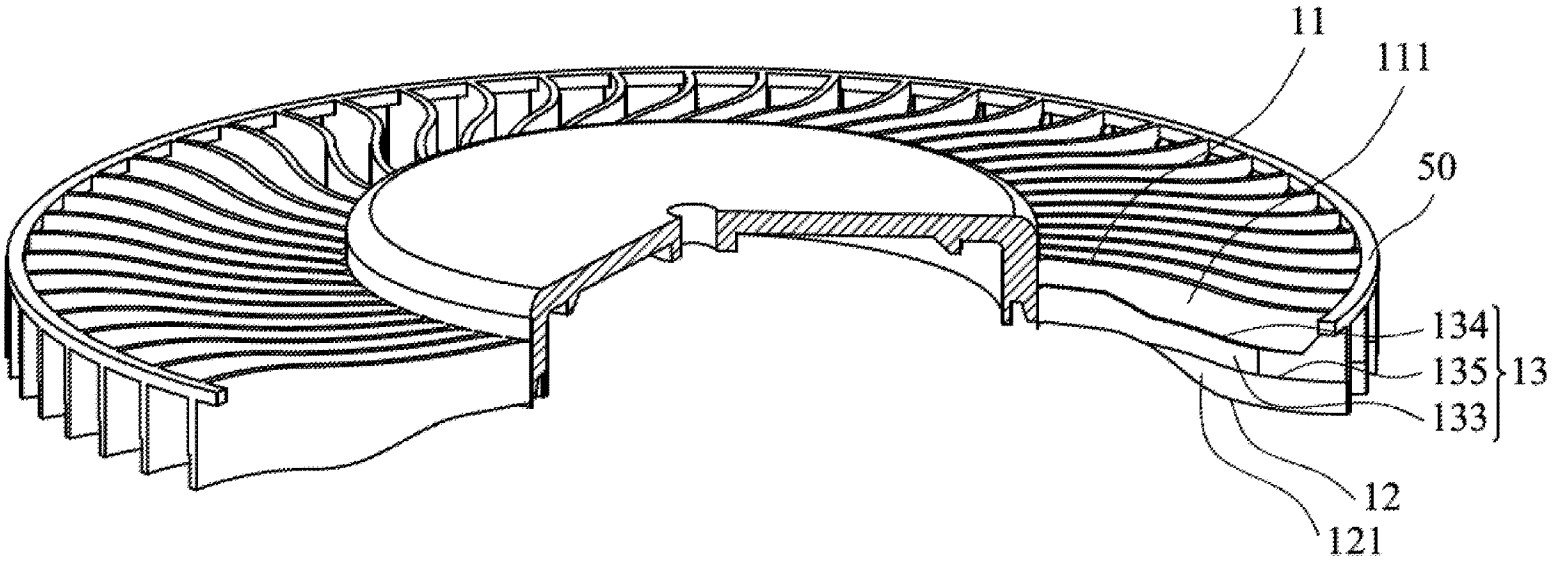
FIG. 2B is a perspective view of a portion of the centrifugal blower of the second embodiment of the invention.
Figure 3A:
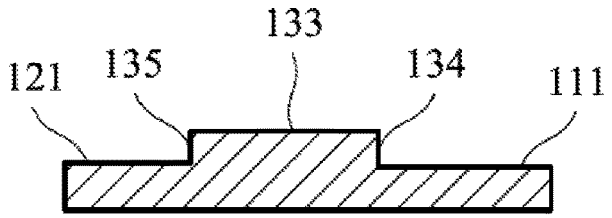
FIGS. 3A-3E show the cross sections of the blades of different embodiments.
Figure 3B:
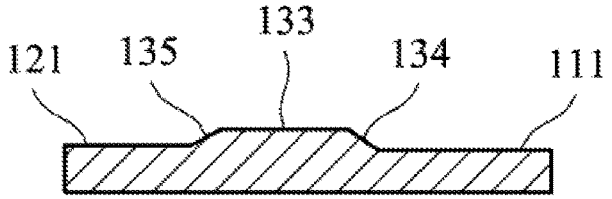
Figure 3C:
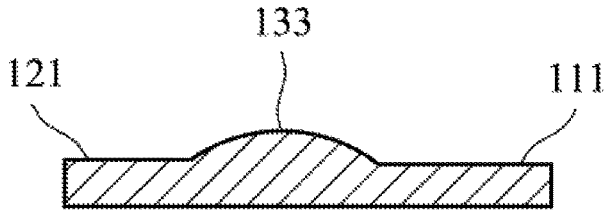
Figure 3D:
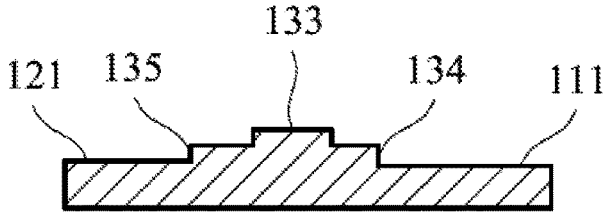
Figure 3E:
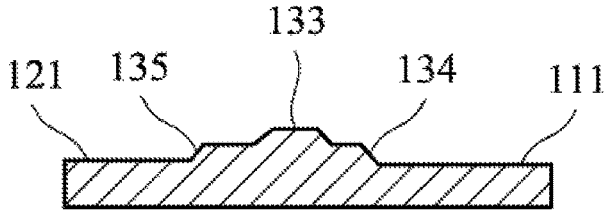

FIG. 2A shows a centrifugal blower 2 of a second embodiment of the invention. FIG. 2B is a perspective view of the centrifugal blower 2 of the second embodiment of the invention. With reference to FIGS. 2A and 2B, in this embodiment, each blade 10 comprises a second fin 12. The second fin 12 is disposed on a second side 132 of the rib 13. The second fin 12 comprises a second surface 121. The rib 13 protrudes from the second surface 121. The thickness of the second fin 12 is less than the thickness of the rib 13. In this embodiment, the rib 13 comprises a top surface 133, a first lateral surface 134 and a second lateral surface 135. With reference to FIG. 3A, in one embodiment, the first lateral surface 134 is substantially perpendicular to the top surface 133, and the second lateral surface 135 is substantially perpendicular to the top surface 133. The first lateral surface 134 is connected to the first surface 111 of the first fin 11. The second lateral surface 135 is connected to the second surface 121 of the second fin 12. With reference to FIG. 3B, in another embodiment, the first lateral surface 134 and the second lateral surface 135 can also be inclined surfaces. With reference to FIGS. 3C-3E, the cross section of the blade can have different shapes.

With reference to FIG. 2A, in one embodiment, the centrifugal blower further comprises a housing 20, a hub 31, a shaft 32 and a motor 40. The shaft 32 is connected to the hub 31. The motor 40 rotates the shaft 32. A first inlet 21 is formed between the housing 20 and the hub 31. A second inlet 22 is formed between the housing 20 and the motor 40. The first fin 11 extends toward the first inlet 21. The second fin 12 extends toward the second inlet 22. In this embodiment, each blade 10 comprises a notch 14, and the notch 14 is formed between the second fin 12 and the motor 40. In one embodiment, the notch 14 is utilized for preventing the second fin 12 from interfered with the motor 40. In e modified example, another notch can be formed on the first fin 11. The disclosure is not meant to restrict the invention.

In one embodiment, the environmental wind resistance of the first inlet 21 is lower than the environmental wind resistance of the second inlet 22. The environmental wind resistance refers to the wind resistance generated by the elements (for example, a circuit board or chip) surrounding the centrifugal blower. When the environmental wind resistance of the first inlet 21 is lower than the environmental wind resistance of the second inlet 22, the thickness of the second fin 12 is greater than the thickness of the first fin 11 to draw more air flow through the first inlet 21 of lower environmental wind resistance.

Similar to the first embodiment, each thickness of the first fin 11 and the second fin 12 is less than the thickness of the rib 13. The rib 13 (thicker structure) provides sufficient structural strength to the blade 10. The first fin (thinner structure) 11 and the second fin (thinner structure) 12 impel air flow. Because the thicknesses of the first fins 11 and the second fins 12 are decreased, the gaps between the neighboring first fins 11 and the gaps between the neighboring second fins 12 are increased. The wind resistance and noise of the centrifugal blower are decreased, and the air flow of the centrifugal blower is increased. In one embodiment, the thickness of the rib is 0.3~0.6 mm, the thickness of the first fin is 0.15~0.35 mm, and the thickness of the second fin is 0.15~0.35 mm. The width of the rib is 30~50% of the total width of the blade, the width of the first fin is 20~60% of the total width of the blade, and the width of the second fin is 20~60% of the total width of the blade. A ratio of the gap between the blades and the width of the first fin is 4.5~12. In one embodiment, the total width of the blade is 1.2~5 mm.

According to the ratio above, the wind resistance of the centrifugal blower is decreased, and the air flow of the centrifugal blower is increased. Additionally, the structural strength and reliability of the centrifugal blower is improved.

With reference to FIGS. 2A and 2B, in this embodiment, the centrifugal blower 1 further comprises a supporting ring 50. The supporting ring 50 is connected to the ends of the blades 10. The rib 13 comprises a main section 136 and an end section 137. The thickness of the main section 136 is greater than the thickness of the end section 137. The main section 136 is located between the end section 137 and the hub 31. The end section is substantially trapezoid-shaped. The top of the trapezoid-shaped end section 137 is connected to the supporting ring. The end section 137 is connected to the supporting ring 50. In this embodiment, the thickness of the main section is 0.3~0.6 mm, and the thickness of the end section is 0.3~0.6 mm. The thickness of the end section can be ununiformed, which can also be an inclined surface. The supporting ring 50 further increases the structural strength of the centrifugal blower 1.

With reference to FIGS. 2A and 2B, in another embodiment, a centrifugal blower 1 is provided, which includes a plurality of blades 10. Each blade 10 includes a rib 13 and a first fin 11. The first fin 11 is disposed on a first side 131 of the rib 13. The first fin 11 comprises a first curved surface. The rib comprises a top curved surface 133. The thickness of the first fin 11 is less than the thickness of the rib 13. The first curved surface is separated from (discontinuous) the top curved surface 133. In other words, a level deference is formed between the first curved surface 11 and the top curved surface 133.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term).

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A centrifugal blower, comprising:

a hub;

a shaft, connected to the hub;

a motor, rotating the shaft; and a plurality of blades, wherein each blade comprises:

a rib, connected to the hub, wherein the rib extends from the hub to an end of the blade; and a first fin, disposed on a first side of the rib and connected to the hub, wherein the first fin comprises a first surface, the rib protrudes from the first surface, and a thickness of the first fin is less than a thickness of the rib, wherein each blade comprises a second fin, the second fin is disposed on a second side of the rib, the second fin comprises a second surface, the rib protrudes from the second surface, and a thickness of the second fin is less than the thickness of the rib, wherein the rib comprises a top surface, a first lateral surface and a second lateral surface, the first lateral surface and the second lateral surface are inclined surfaces, the first lateral surface is connected to the first surface of the first fin, the second lateral surface is connected to the second surface of the second fin; and a housing, wherein a first inlet is formed between the housing and the hub, a second inlet is formed between the housing and the motor, the first fin extends toward the first inlet, and the second fin extends toward the second inlet, wherein the thickness of the second fin is greater than the thickness of the first fin.

2. The centrifugal blower as claimed in claim 1, wherein the rib comprises a top surface and a first lateral surface, the first lateral surface is an inclined surface, and the first lateral surface is connected to the first surface of the first fin.

3. The centrifugal blower as claimed in claim 1, wherein the thickness of the rib is 0.3~0.6 mm, the thickness of the first fin is 0.15~0.35 mm, a width of the rib is 30~50% of a total width of the blade, and a width of the first fin is 50~70% of the total width of the blade.

4. The centrifugal blower as claimed in claim 1, wherein environmental wind resistance of the first inlet is lower than environmental wind resistance of the second inlet.

5. The centrifugal blower as claimed in claim 1, wherein the thickness of the rib is 0.3~0.6 mm, the thickness of the first fin is 0.15~0.35 mm, the thickness of the second fin is 0.15~0.35 mm, a width of the rib is 30~50% of a total width of the blade, a width of the first fin is 20~60% of the total width of the blade, and a width of the second fin is 20~60% of the total width of the blade.

6. The centrifugal blower as claimed in claim 1, wherein each blade comprises a notch, and the notch is formed between the second fin and the motor.

7. The centrifugal blower as claimed in claim 1, further comprising a supporting ring, wherein the supporting ring is connected to the ends of the blades.

8. The centrifugal blower as claimed in claim 1, wherein the rib comprises a main section and an end section, a thickness of the main section is greater than a thickness of the end section, and the main section is located between the end section and the hub.

9. The centrifugal blower as claimed in claim 8, further comprising a supporting ring, wherein the supporting ring is connected to the ends of the blades, each end section is connected to the supporting ring, the end section is substantially trapezoid-shaped, and a side of the trapezoid-shaped end section is connected to the supporting ring.

10. The centrifugal blower as claimed in claim 8, wherein the thickness of the main section is 0.3~0.6 mm, and the thickness of the end section is 0.3~0.6 mm.

* * * * *